United States Patent [19]

Speil

[11] Patent Number: 4,864,982

[45] Date of Patent: Sep. 12, 1989

[54] INNER ELEMENT FOR AN HYDRAULIC VALVE PLAY COMPENSATION ELEMENT

[75] Inventor: Walter Speil, Ingolstadt, Fed. Rep. of Germany

[73] Assignee: Motomak Motorenbau, Maschinen- und Werkzeugfabrik, Konstruktionen GmbH, Fed. Rep. of Germany

[21] Appl. No.: 575,915

[22] Filed: Feb. 1, 1984

[30] Foreign Application Priority Data

Feb. 10, 1983 [DE] Fed. Rep. of Germany ..... 3304573

[51] Int. Cl.[4] ..... F01L 1/24

[52] U.S. Cl. ..... 123/90.55; 123/90.46

[58] Field of Search ..... 123/90.46, 90.55, 90.57, 123/90.58

[56] References Cited

U.S. PATENT DOCUMENTS

| | | | |
|---|---|---|---|
| 2,090,795 | 8/1937 | Johnson | 123/90.57 |
| 2,220,336 | 11/1940 | Johnson et al. | 123/90.55 |
| 2,665,669 | 1/1954 | Ellis | 123/90.55 |
| 2,672,133 | 3/1954 | Etchells | 123/90.55 |
| 2,887,996 | 5/1959 | Wood | 123/90.56 |
| 2,943,613 | 7/1960 | Line | 123/90.55 |
| 3,542,001 | 11/1970 | Line | 123/90.55 X |

*Primary Examiner*—Ira S. Lazarus
*Assistant Examiner*—Peggy Neils
*Attorney, Agent, or Firm*—Bierman & Muserlian

[57] ABSTRACT

A novel inner element for hydraulic valve play compensation element for internal combustion engines comprised of a cylindrical element (1) closed at one end, (2) a piston element (3) guided therein for longitudinal displacement and a helical spring (8) in the cylindrical element (1) bearing against the inner surface of the closed end (2) and against the piston element (3) characterized in that the bore (4) of the cylindrical element (1) is provided adjacent to the closed end (2) with an increased diameter (9) and contiguous to the end of piston element (3) at the closed end (2) of the cylindrical element (1) is a structural element (8,10) provided with at least one projection (11) engaging the increased diameter (9) of the bore (4).

2 Claims, 2 Drawing Sheets

INNER ELEMENT FOR AN HYDRAULIC VALVE PLAY COMPENSATION ELEMENT

STATE OF THE ART

Inner elements for insertion into a bore of a rocker arm or into a so-called cap plunger which is arranged directly between a cam and a valve stem in a slide guide are known and measures have been proposed to prevent the piston element from slipping out of the cylindrical element of the inner element. For example, the piston element has been provided with a reduced diameter at its free end which engages a radical flange of a sheet metal cap which flange in turn is form-lockedly fastened to the open end of the cylindrical element. Such a securing arrangement functions satisfactorily, but it causes a functional disadvantage for the inner element since the piston and cylindrical element include the high-pressure oil chamber that effects the play compensation. The cylindrical gap between these two structural parts forms a leakage gap through which a small amount of oil can issue and if a reduced diameter is provided at the end of the piston element, the length of the leakage gap is shortened resulting in an undesired increase in the amount of oil issuing via the leakage gap.

OBJECTS OF THE INVENTION

It is an object of the invention to provide an inner element construction whereby the slippage of the piston element from the cylindrical element can be prevented at a minimum expense and without shortening of the leakage gap.

This and other objects and advantages of the invention will become obvious from the following detailed description.

THE INVENTION

The novel inner element of the invention for hydraulic valve play element for internal combustion engines is comprised of a cylindrical element (1) closed at one end, (2) a piston element (3) guided therein for longitudinal displacement and a helical spring (8) in the cylindrical element (1)bearing against the inner surface of the closed end (2) and against the piston element (3) characterized in that the bore (4) of the cylindrical element (1) is provided adjacent to the closed end (2) with an increased diameter (9) and contiguous to the end of piston element (3) at the closed end (2) of the cylindrical element (1) is a structural element (8,10) provided with at least one projection (11) engaging the increased diameter (9) of bore (4).

The diameter enlargement in the bore of the cylindrical element does not cause a shortening of the leakage gap since diameter enlargement must be provided due to bore machining for discharge or removal of the machining tool.

The structural element contiguous to the end of the piston element engaging the increased diameter of the bore can be the helical spring itself in the simplest form to avoid any additional elements. This means that the piston element is not actively retained in the cylindrical element but the helical spring is merely prevented from pushing the piston element out of the cylindrical element since the spring movement is restrained by the upper part of the increased diameter. Usually this is adequate since the piston element seated in the cylindrical element with a relatively close fit has no reason itself to slip from the cylindrical element.

The piston element may also be actively retained in the bore of the cylindrical element by providing an additional structural element which is secured to the piston element and projects radially into the increased diameter of the bore of the cylindrical element. For example, this may be a sheet metal tongue secured to the piston element.

Referring now to the drawings.

Figure 1:
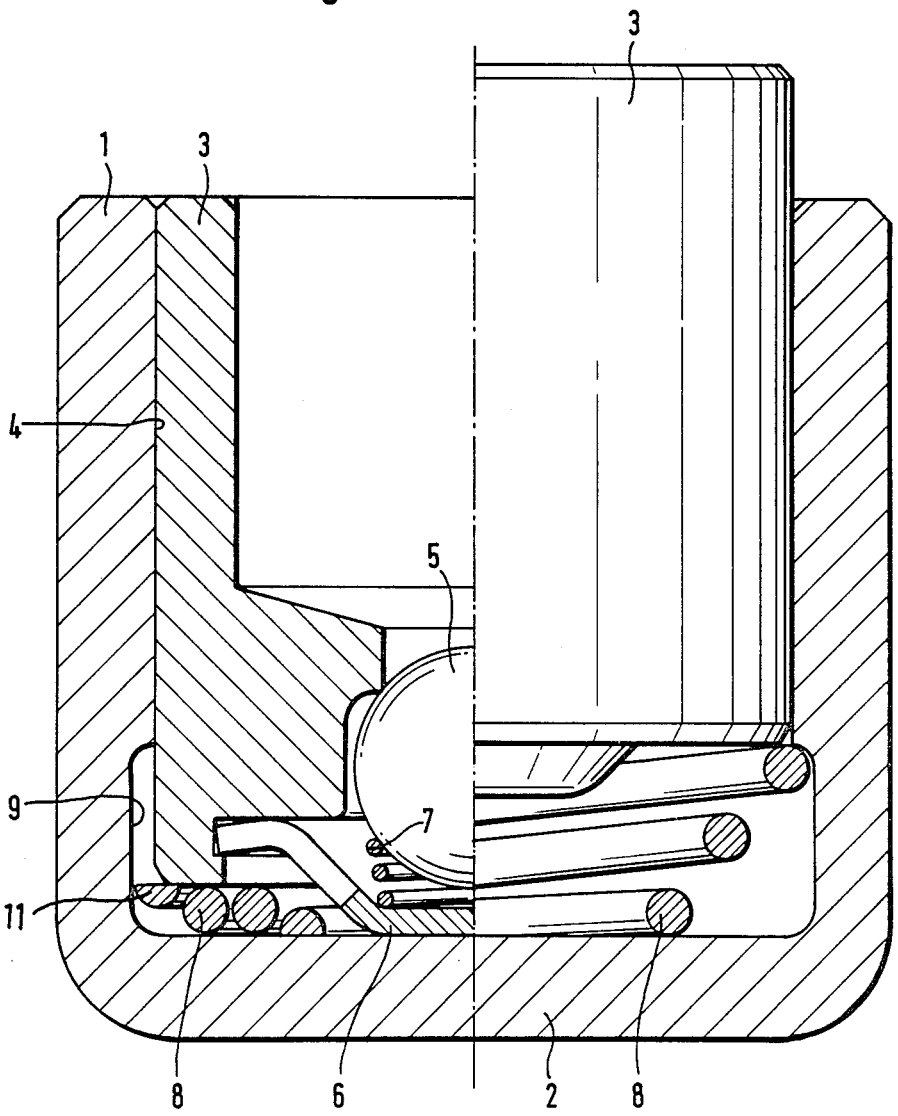
FIG. 1 is longitudinal cross-section of an inner element of the invention with the left half of the FIG. showing the completely compressed state and the right half of the Fig. showing the expanded state of the element.

In FIG. 1, a known check valve is arranged in piston element 5 consisting of ball 5, valve cap 6 and helical spring 7 and a helical spring 8 shown in the form of a conical spring is disposed between the closed end 2 of cylindrical element 1 and piston element 3 which tends to push the piston element 3 out of cylindrical element 1. As can be seen from the left half of FIG. 1, this construction has the advantage that piston element 3 can be pressed so close to the closed end 2 that the distance between the two elements is only the thickness of the spring wire. Bore 4 is provided at the end adjacent to the closed end 2 with an increased diameter 9 and the greatest diameter of conical spring 8 is selected so that the spring radially projects beyond piston element 3 and engages the increased diameter 9 of cylindrical element 1. As can be seen from the right half of FIG. 1, this construction permits the spring 8 to expand only within the increased diameter without any danger of the piston element 3 being pushed completely out of cylindrical element 1.

Figure 2:
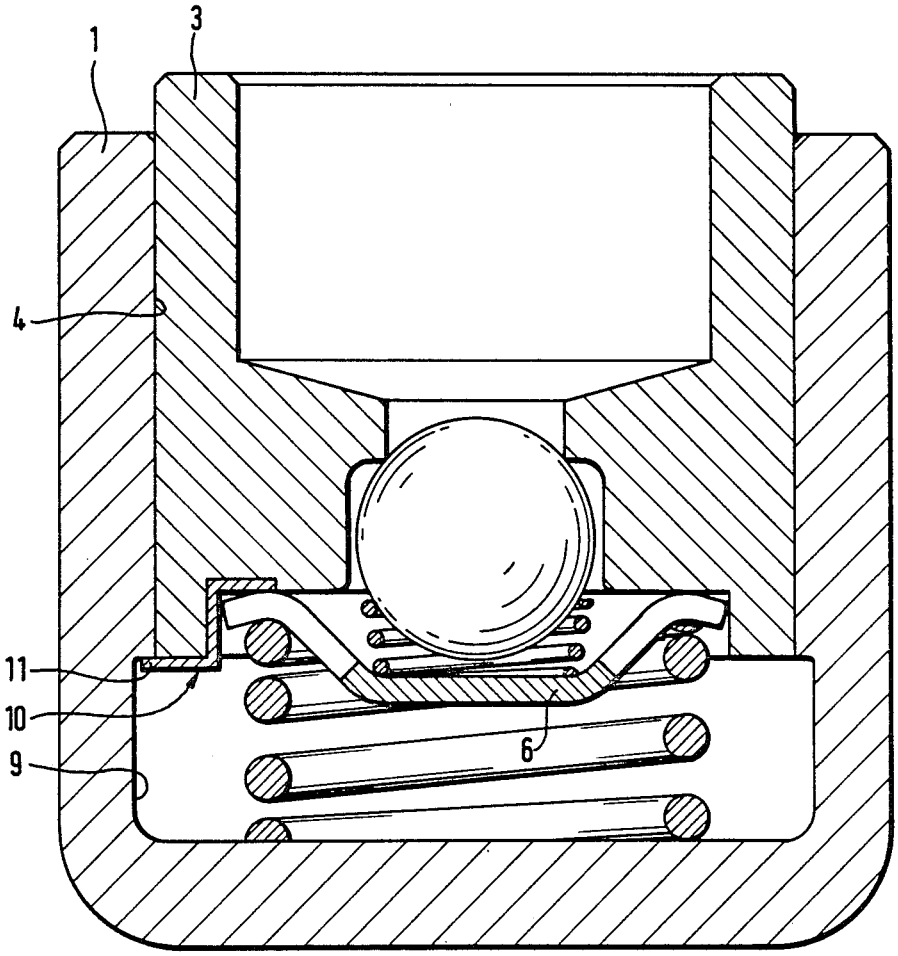
FIG. 2 is a longitudinal cross-section of an other embodiment of an inner element of the invention provided with a tongue secured to the piston element.

In the embodiment illustrated in FIG. 2, the pushing of piston element 3 out of cylindrical element 1 is avoided by providing an additional structural element which actively restrain the piston element 3. A sheet metal strip 10 of approximately Z-shaped cross-section is inserted in a corresponding recess of piston element 3 and is firmly secured thereto by valve cap 6. The strip 10 has a radical tongue 11 which engages increased diameter 9 whereby after a predetermined length of travel, the tongue abuts against the offset existing at the transition point from increased diameter 9 into bore 4.

Various modifications of the inner element of the invention may be made without departing from the spirit or scope thereof and it is to be understood that the invention is intended to be limited only as defined in the appended claims.

What I claim is:

1. An inner element for an hydraulic valve play compensation element for internal combustion engines comprised of a cylindrical element (1) closed at one end, (2) a piston element (3) guided therein for longitudinal displacement and a helical spring (8) in the cylindrical element (1) bearing against the inner surface of the closed end (2) and against the piston element (3) characterized in that the bore (4) of the cylindrical element (1) is provided adjacent to the closed end (2) with an increased diameter (9) and contiguous to the end of piston element (3) at the closed end (2) of the cylindrical element (1) and helical spring (8) is provided with at least one projection (11) engaging the increased diameter (9) of bore (4).

2. An inner element for an hydraulic valve play compensation element for internal combustion engines comprised of a cylindrical element (1) closed at one end, (2) a piston element (3) guided therein for longitudinal displacement and a helical spring (8) in the cylindrical element (1) bearing against the inner surface of the closed end (2) and against the piston element (3) characterized in that the bore (4) of the cylindrical element (1) is provided adjacent to the closed end (2) with an increased diameter (9) and contiguous to the end of piston element (3) at the closed end (2) of the cylindrical element (1) and an additional element (10) is secured to piston element (3) and engages the increased diameter (9).

* * * * *